US012121776B2

(12) United States Patent
Tomlinson et al.

(10) Patent No.: US 12,121,776 B2
(45) Date of Patent: Oct. 22, 2024

(54) SPORTS BALL WITH SUSPENSION SYSTEM

(71) Applicant: adidas AG, Herzogenaurach (DE)

(72) Inventors: Scott Tomlinson, Portland, OR (US); Ian Michael Munson, Portland, OR (US); Barry Grant Mannie, Vancouver, WA (US); Christian Walter DiBenedetto, North Plains, OR (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 17/856,302

(22) Filed: Jul. 1, 2022

(65) Prior Publication Data

US 2024/0001203 A1 Jan. 4, 2024

(51) Int. Cl.
*A63B 43/00* (2006.01)
*A63B 45/00* (2006.01)

(52) U.S. Cl.
CPC ..... *A63B 43/004* (2013.01); *A63B 45/00* (2013.01); *A63B 2220/833* (2013.01); *A63B 2225/50* (2013.01); *A63B 2243/0025* (2013.01)

(58) Field of Classification Search
CPC ..... A63B 43/004; A63B 2220/833; A63B 2243/0025; A63B 43/002; A63B 43/06
See application file for complete search history.

(56) References Cited

U.S. PATENT DOCUMENTS 996,458 A * 6/1911 Coleman ..... A63F 7/044 273/DIG. 20
2,020,484 A * 11/1935 Turner ..... A63B 43/06 473/570
5,725,445 A * 3/1998 Kennedy ..... A63B 43/06 473/570
6,398,616 B1 * 6/2002 Motosko, III ..... A63B 41/00 473/594
6,537,125 B1 * 3/2003 Motosko, III ..... A63B 41/125 482/77
7,740,551 B2 * 6/2010 Nurnberg ..... A63B 43/00 473/570
7,976,416 B2 * 7/2011 Kobayashi ..... A63B 43/00 473/600
8,512,177 B2 * 8/2013 Krysiak ..... A63B 43/004 473/570
9,849,361 B2 * 12/2017 Coza ..... G09B 19/0038
(Continued)

FOREIGN PATENT DOCUMENTS

CN 204485230 U 7/2015
CN 106310615 A 1/2017
(Continued)

*Primary Examiner* — Steven B Wong

(74) *Attorney, Agent, or Firm* — Sterne, Kessler, Goldstein & Fox P.L.L.C.

(57) ABSTRACT

A sports ball, for example a soccer ball, comprising a hollow shell and a pit suspended within the hollow shell by a plurality of cords. In some embodiments, the plurality of cords may comprise a first end coupled to the hollow shell at a first location, a second end coupled to the hollow shell at a second location, and a center portion coupled to the pit. In some embodiments, the pit may be suspended within the hollow shell by a plurality of cords, with each of the plurality of cords comprising a frayed end secured to the hollow shell at one of a plurality of spaced apart locations.

23 Claims, 11 Drawing Sheets

(56) References Cited

U.S. PATENT DOCUMENTS

| | | | | |
|---|---|---|---|---|
| 9,908,008 | B2 * | 3/2018 | Fang | A63B 43/06 |
| 9,925,426 | B2 * | 3/2018 | Fang | F21V 15/01 |
| 10,523,053 | B2 * | 12/2019 | Munson | H02J 7/00034 |
| 10,806,972 | B1 * | 10/2020 | Lin | A63B 41/00 |
| 2007/0037641 | A1 * | 2/2007 | Wong | A63B 43/04 473/594 |
| 2010/0069181 | A1 * | 3/2010 | Lin | A63B 43/06 473/570 |
| 2015/0343273 | A1 | 12/2015 | Krysiak et al. | |

FOREIGN PATENT DOCUMENTS

| | | | | | |
|---|---|---|---|---|---|
| CN | 109621339 | A * | 4/2019 | | A63B 41/02 |
| CN | 115068912 | A * | 9/2022 | | |
| EP | 2281610 | B1 | 5/2017 | | |
| EP | 3 287 175 | A1 | 2/2018 | | |
| WO | WO-2010043411 | A1 * | 4/2010 | | A63B 39/00 |

* cited by examiner

SPORTS BALL WITH SUSPENSION SYSTEM

FIELD

The present disclosure relates to a sports ball, in particular a football or soccer ball.

BACKGROUND

Sports balls, such as soccer balls, used in sporting activities may comprise a hollow shell, including bladder. The hollow shell may be empty or may comprise one or more electronic devices to provide information regarding various parameters of the sporting activity. Information may comprise the position of the ball at any time during the sporting activity, parameters of the ball and/or the performance of individual players. The information may be desirable to individuals watching the game, referees, and other persons monitoring the game for compliance with the rules, or trainers or the athlete for performance and medical monitoring.

Including electronic devices in the hollow shell such that information can be accurately and consistently collected is challenging, particularly in larger balls with inflatable bladders. Solutions for overcoming the challenges in providing an electronic device within the hollow shell may be difficult to achieve and may significantly increase manufacturing costs. A need exists for innovative solutions that overcome these challenges.

BRIEF SUMMARY

A first embodiment (1) of the present disclosure is directed to a sports ball, comprising a hollow shell; and a pit suspended within the hollow shell by a plurality of cords, each of the plurality of cords comprising a first end coupled to the hollow shell at a first location, a second end coupled to the hollow shell at a second location, and a center portion coupled to the pit.

In a second embodiment (2), the first location according to the first embodiment (1) comprises a first pad bonded to an exterior surface of the hollow shell, and the second location comprises a second pad bonded to the exterior surface of the hollow shell.

In a third embodiment (3), each of the plurality of cords according to the second embodiment (2) is a fibrous cord the first end comprises frayed fibers of the cord, and the frayed fibers are bonded to the first pad.

In a fourth embodiment (4), the first pad according to the third embodiment (3) comprises a first pad layer and a second pad layer and the frayed fibers according to the third embodiment (3) are sandwiched between the first pad layer and the second pad layer.

In a fifth embodiment (5), the first pad layer according to the fourth embodiment (4) comprises an opening through which the first end of the cord is received.

In a sixth embodiment (6), the frayed fibers according to the fifth embodiment (5) extend radially from the opening.

In a seventh embodiment (7), the first pad layer according to any one of embodiments (4)-(6) comprises a first effective diameter and the second pad layer according to any one of embodiments (4)-(6) comprises a second effective diameter greater than the first effective diameter.

In an eighth embodiment (8), the first pad, the second pad, and the hollow shell according to any one of embodiments (2)-(7) comprise the same material.

In a ninth embodiment (9), the center portion of each of the plurality of cords according to any one of embodiments (1)-(8) is looped through the pit.

In a tenth embodiment (10), the center portion of each of the plurality of cords according to any one of embodiments (1)-(9) comprises a knot arranged in one of a plurality of sockets located on an exterior surface of the pit.

In an eleventh embodiment (11), the center portion of each of the plurality of cords according to any one of embodiments (1)-(9) is looped through one of a plurality of grooves located on an exterior surface of the pit.

In a twelfth embodiment (12), the center portion of each of the plurality of cords according to the eleventh embodiment (11) comprises a knot disposed within one of the plurality of grooves.

In a thirteenth embodiment (13), each of the plurality of grooves according to the twelfth embodiment (12) comprises a first curve, a second curve, and a socket connecting the first curve and the second curve.

In a fourteenth embodiment (14), the knot of each of the plurality of cords according to the thirteenth embodiment (13) is disposed in the socket of one of the plurality of grooves.

In a fifteenth embodiment (15), each of the plurality of cords according to the thirteenth embodiment (13) or the fourteenth embodiment (14) extends to a respective one of the first locations from the first curve of one of the plurality of grooves and extends to a respective one of the second locations from the second curve of one of the plurality of grooves.

In a sixteenth embodiment (16), the pit according to any one of embodiments (1)-(9) comprises a plurality of sockets, each of the sockets comprising a recessed portion surrounded by a wall.

In a seventeenth embodiment (17), the center portion of each of the plurality of cords according to the sixteenth embodiment (16) is fixed in the recessed portion of one of the sockets.

In an eighteenth embodiment (18), each of the plurality of cords according to any one of embodiments (1)-(16) comprises a first cord line extending from an exterior surface of the pit along a first axis and a second cord line extending from the exterior surface of the pit along a second axis.

In a nineteenth embodiment (19), an angle ($\alpha$) between the first axis and the second axis according to the eighteenth embodiment (18) is greater than or equal to 10 degrees.

In a twentieth embodiment (20), the first location and the second location according to any one of embodiments (1)-(19) are spaced equidistantly around a surface area of the hollow shell.

In a twenty-first embodiment (21), each of the plurality of cords according to any one of embodiments (1)-(20) is a continuous cord extending from the first end to the second end.

In a twenty-second embodiment (22), the hollow shell according to any one of embodiments (1)-(21) comprises an inflatable bladder.

In a twenty-third embodiment (23), the pit according to any one of embodiments (1)-(22) comprises an electronic device.

In a twenty-fourth embodiment (24), the electronic device according to the eighteenth embodiment (23) comprises a battery and a wireless transmitter.

In a twenty-fifth embodiment (25), the electronic device according to the twenty-third embodiment (23) or the twenty-fourth embodiment (24) comprises a sensor selected from the group consisting of: a pressure sensor, a global positioning system sensor, an accelerometer, a magnetometer, a gyroscope, a hall sensor, a temperature sensor, a cellular phone module, and a combination thereof.

In a twenty-sixth embodiment (26), the pit according to any one of embodiments (1)-(25) comprises a mass ranging from 22 grams to 26 grams.

In a twenty-seventh embodiment (27), the pit according to any one of embodiments (1)-(25) comprises a mass of less than or equal to 50 grams.

A twenty-eighth embodiment (28) of the present disclosure is directed to a method of making a sports ball, the method comprising: coupling a plurality of cords to a pit such that each of the cords comprises a first end, a second end, a center portion coupled to the pit; disposing the pit within a hollow shell, the hollow shell comprising a plurality of first openings and a plurality of second openings; pulling the first end of each cord through a respective one of the plurality of first openings; pulling the second end of each cord through a respective one of the plurality of second openings; attaching a plurality of first pads to the first ends of each cord pulled through the respective one of the plurality of first openings, each first pad attached to a respective one of the first ends; attaching a plurality of second pads to the second ends of each cord pulled through the respective one of the plurality of second openings, each second pad attached to a respective one of the second ends; bonding each of the first pads to the hollow shell at a respective one of the first openings; and bonding each of the second pads to the hollow shell at a respective one of the second openings.

In a twenty-ninth embodiment (29), bonding each of the first pads and the second pads to the hollow shell according to the twenty-eighth embodiment (28) seals the plurality of first openings and the plurality of second openings.

In a thirtieth embodiment (30), attaching the plurality of first pads to the first ends of each cord according to the twenty-eighth embodiment (28) or the twenty-ninth embodiment (29) comprises fraying the first end of each cord, and gluing the frayed first ends to the first pads with an adhesive.

In a thirty-first embodiment (31), fraying the first end of each cord according to the thirtieth embodiment (30) comprises twisting the cord open.

In a thirty-second embodiment (32), attaching the plurality of first pads to the first ends of each cord according to the thirtieth embodiment (30) or the thirty-first embodiment (31) further comprises curing the adhesive.

In a thirty-third embodiment (33), the adhesive according to the thirty-second embodiment (32) comprises a rubber adhesive and curing the adhesive comprises vulcanizing the rubber.

In a thirty-fourth embodiment (34), the center portion of each of the plurality of cords according to any one of embodiments (28)-(33) comprises a knot.

In a thirty-fifth embodiment (35), the method according to any one of embodiments (28)-(34) further comprising cutting the first ends of each cord pulled through the respective one of the plurality of first openings and the second ends of each cord pulled through the respective one of the plurality of second openings such that the plurality of cords comprise: a first cord line extending from an exterior surface of the pit and having a first length measured from the exterior surface to the first end, and a second cord line extending from the exterior surface of the pit and having a second length measured from the exterior surface to the second end and equal to the first length.

A thirty-sixth embodiment (36) of the present disclosure is directed to a sports ball comprising a hollow shell; and a pit suspended within the hollow shell by a plurality of cords, each of the plurality of cords comprising a frayed end secured to the hollow shell at one of a plurality of spaced apart locations.

In a thirty-seventh embodiment (37), each of the spaced apart locations according to the thirty-sixth embodiment (36) comprises a pad bonded to an exterior surface of the hollow shell.

In a thirty-eighth embodiment (38), the frayed end of each cord according to the thirty-seventh embodiment (37) is bonded to the pad at each respective spaced apart location.

In a thirty-ninth embodiment (39), the frayed end of each cord according to any one of embodiments (36)-(38) comprises frayed fibers comprising a length of greater than or equal to 10 millimeters.

BRIEF DESCRIPTION OF THE DRAWINGS

The accompanying drawings, which are incorporated herein and form a part of the specification, illustrate embodiments of the present disclosure. Together with the description, the drawings further serve to explain the principles of and to enable a person skilled in the pertinent art to make and use the disclosed embodiments.

DETAILED DESCRIPTION

Figure 1:
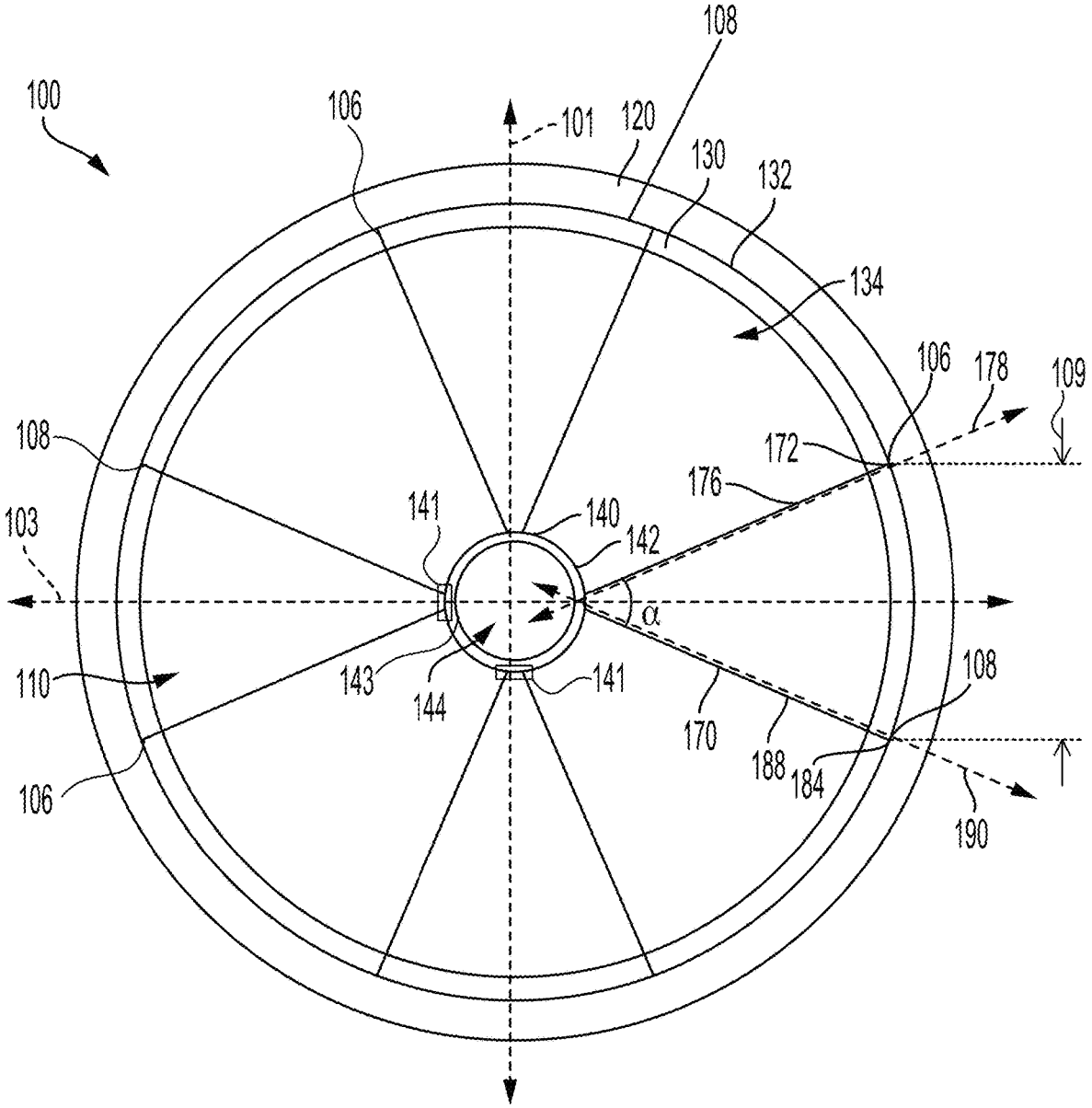
FIG. 1 shows a ball according to some embodiments.
Figure 2:
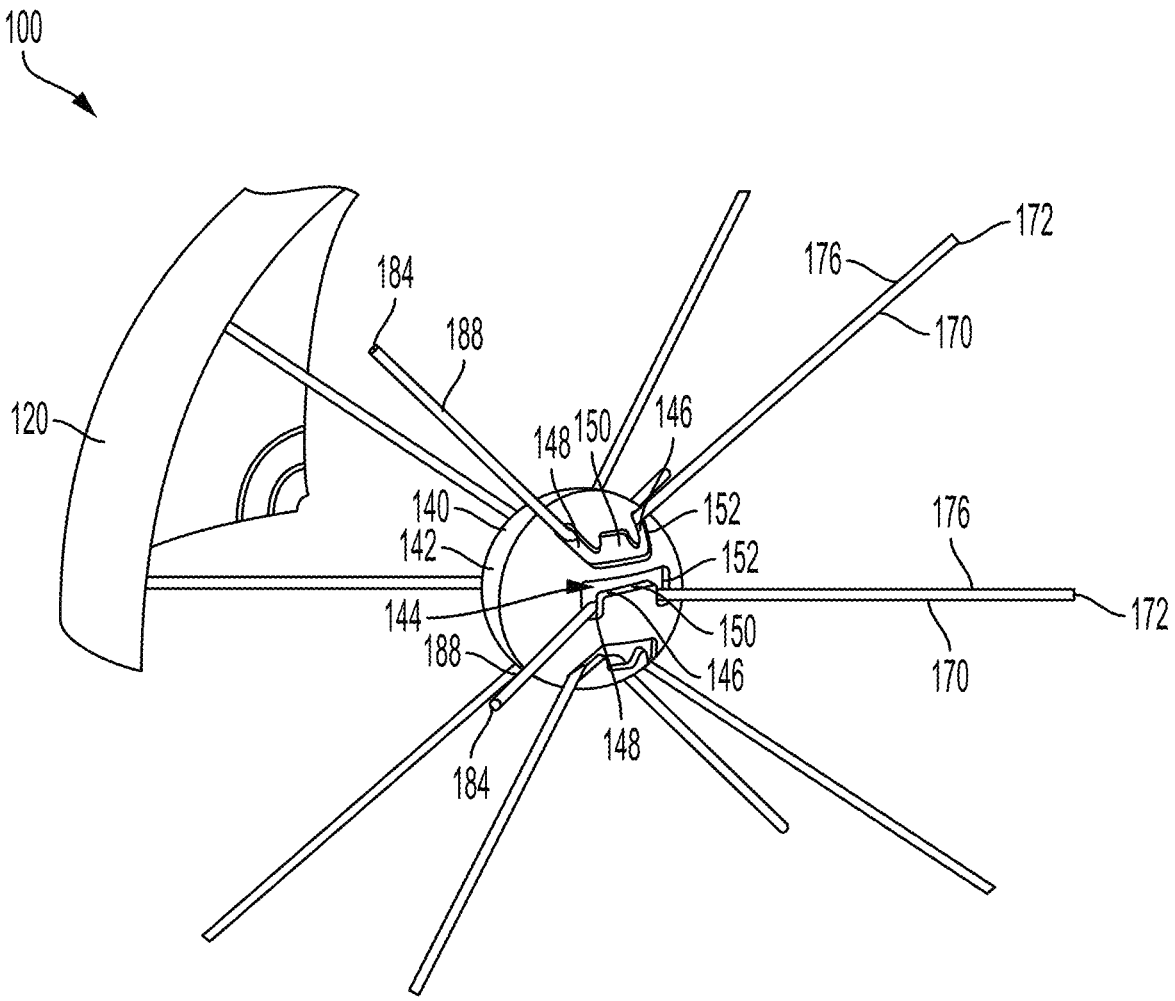
FIG. 2 shows a perspective view of an interior of the ball of FIG. 1.

Embodiments of the present disclosure are described in detail with reference to embodiments thereof as illustrated in the accompanying drawings. References to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The systems and methods described herein provide a sports ball for use in an athletic activity. The sports ball may have a hollow shell and a suspension system for suspending a pit within the hollow shell. The hollow shell may comprise a bladder. In particular embodiments, the bladder may be an inflatable bladder. The suspension system of the ball may comprise one or more cords coupled to the hollow shell. The cord(s) may be continuous cords having first and second ends coupled to the hollow shell at spaced apart locations. The cords may be coupled to the pit and the hollow shell such that the cords are under tension within the sports ball. The tension in the cords can locate, support, and cushion the pit within the hollow shell.

The sports ball according to embodiments described herein provides improved systems and methods for supporting a center mass within a hollow shell of the sports ball. The design and configuration of the suspension system according to embodiments described herein can focus the mass of the suspension system at the center of the ball—at or around the pit suspended by the suspension system. The cords and the locations at which the cords are coupled to the hollow shell can have a lightweight design, which centers the mass of the system at the center of the ball. In some embodiments, the design and configuration of the suspension system and pit as described herein can optimize weight characteristics of the ball for compliance with official sporting regulations, for example International Federation of Association Football (FIFA) standards.

In addition, one or more electronic devices may be suspended within the hollow shell using the suspension systems described herein to secure the device(s) and provide cushioning for any mechanical loads arising under deformations or accelerations of the ball during use. During sporting events, it can be important to detect acceleration, such as to determine when a ball is kicked. This information regarding when the ball is kicked can be correlated with position information of various players, for example to determine whether a player is in an offside position. Further, it can be important to know the exact position of the ball, such as to determine whether the ball has crossed a goal line. Accordingly, electronic devices must perform optimally to provide accurate position information. The suspension systems described herein can fix the electronic devices in the center of the ball such that an electronic device is consistently positioned at the intersection of central longitudinal and lateral axes of the ball. Electronic devices can be fixed in this way as the ball experiences deformations and spin, limiting or preventing operational interferences and any effects on accuracy of information gathered by the electronic devices. The suspension systems can also reliably limit or prevent damage of the electronic devices as the electronic devices are fixed in the center of the ball.

A method of making the sports ball according to embodiments described herein may comprise coupling one or more cords to the pit and to the hollow shell at spaced apart locations as described herein. In some embodiments, the spaced part locations may be equidistant over a surface area of the hollow shell. In some embodiments, the cord(s) may be coupled to the hollow shell by bonding opposing ends of the cord to the hollow shell at two spaced apart locations. In some embodiments, the cord(s) may be coupled to the hollow shell by bonding opposing ends of the cord to separate pads, which are bonded to the hollow shell at spaced apart locations. In some embodiments, the suspension system and pit may be manufactured without requiring the hollow shell to be turned inside out.

The cords according to embodiments described herein may comprise a first end coupled to the hollow shell at a first location, a center portion coupled to the pit, and a second end opposite the first end and coupled to the hollow shell at a second location. Accordingly, one cord may thread through the ball from the hollow shell, to the pit, and back to the hollow shell. The two locations where the cord is coupled to the hollow shell may be referred to as anchor points for suspending the pit.

The center portion of the cord may be coupled to the pit using one or more of the following fastening mechanisms that fixedly couple the cord to the pit. The fastening mechanism(s) may couple the cord to the pit such that the pit is maintained in its desired position within the hollow shell during use of the ball.

In some embodiments, the center portion may be coupled to the pit with an adhesive.

In some embodiments, the center portion may be coupled to the pit by overmolding a portion of the pit on the center portion of the cord.

In some embodiments, the center portion of the cord may be coupled to the pit by looping through a groove in the pit. In some embodiments, the cord may be coupled to the pit by fixing the center portion of the cord within a groove in the pit. In some embodiments, the center portion of the cord may comprise a mass fixed within a groove in the pit. In some embodiments, the mass may be a knot in the cord, a separate piece bonded to the center portion of the cord, or a combination thereof.

In some embodiments, the cord may be coupled to the pit by fixing the center portion of the cord within a socket in the pit. In some embodiments, the center portion of the cord may comprise a mass fixed within a socket in the pit. In some embodiments, the mass may be a knot in the cord, a separate piece bonded to the center portion of the cord, or a combination of both. In some embodiments, the socket may comprise walls that fix the mass in place.

In some embodiments, the cord may be coupled to the pit by looping through a groove in the pit and fixing the center portion of the cord within a socket of the groove. In such embodiments, the groove may comprise first and second ends connected by the socket. The socket, disposed between the first end and the second end, may be formed on an exterior surface of the pit and configured to receive the mass at the center portion of the cord. In such embodiments, the cord may extend from the socket and respectively exit the pit at the first end and second end of the groove.

In embodiments comprising a knot in the center portion of the cord, the knot may be tightened, for example by a pneumatic system, before coupling the cord to the pit. Tightening the knot prior to mounting can ensure that the knot will not tighten during the use of the ball, thus causing the cord to loosen.

The first and second ends of the cord may be coupled to the hollow shell using one or more of the following fastening mechanisms that fixedly couple the first and second ends to first and second locations, respectively, on the hollow shell.

In some embodiments, the first and second ends of the cords may be coupled to the hollow shell with an adhesive. In some embodiments, the first and second ends of the cords may be coupled to the hollow shell with a pad bonded to the hollow shell with an adhesive. In some embodiments, the first and second ends of the cords may be directly bonded to the hollow shell. For example, the first and second ends of the cords may be directly heat bonded to the hollow shell.

In some embodiments, the first and second ends of the cords may be coupled to the hollow shell by sandwiching each of the first and second ends between two pad layers of a pad. In such embodiments, a pad comprising the pad layers may be bonded to the hollow shell, thereby coupling the first and second ends to the hollow shell. In some embodiments, the pad may be bonded to an exterior surface of the hollow shell. In some embodiments, the first and second ends may be glued to the pad layers. In some embodiments, the first and second ends may be flattened onto a pad layer such that each of the first and second ends spans all or a portion of the entire effective diameter of the pad layer. In some embodiments, the first and second ends may be frayed to form a flattened portion for attaching to the pad. In such embodiments, the frayed ends may increase the effective diameter of the cords to increase the surface area for fixing cords to pads.

Providing one or more continuous cords as described herein can both simplify the pit suspension and reduce manufacturing costs. For example, the number of cords needed to suspend the pit within the hollow shell can be minimized, thus minimizing material cost. In addition, the one or more cords as described herein can minimize the weight added to the ball by the suspension system. In some embodiments, the cords described herein may be paracords that provide high strength and slight elasticity, with less weight, further limiting the added weight from including the suspension system.

In some embodiments, the pit may be a center mass devoid of any electronic components. In such embodiments, the pit may serve to add weight to the sports ball without contributing any electronic features.

In some embodiments, the pit may comprise one or more electronic devices. In some embodiments, the pit may comprise a sensor casing that comprises one or more electronic devices to provide information regarding various parameters of the athletic activity. The electronic device may comprise a battery, a wireless transmitter, one or more sensors, or any combination thereof. In embodiments comprising one or more sensors, the sensor(s) may provide information regarding various parameters of the sporting activity. The information may comprise the position of the ball at any time during the sporting activity, parameters of the ball, such as an acceleration, a velocity, and a position of the ball, and/or the performance of individual players. In embodiments comprising the wireless transmitter, the transmitter may facilitate communicating the sensed information to one or more stakeholders.

In some embodiments, the pit and electronic devices may be assembled separately with the cords. In some embodiments, the cords and hollow shell may be assembled separately from the pit and electronic devices. In some embodiments, one or more first fixtures may be used to cut a cord to a proper length. First and second cord lines may extend along the first fixtures and be fixed to the first fixtures to cut the cord. These first fixtures may be removed from the ball after assembly, such as after cutting the cord. In some embodiments, second fixtures may be used to bond first end and second end of the cord to one or more layers of patches. In some embodiments, a thin plate, that supports the cord ends on patches bonded to the exterior surface of the hollow shell, may be arranged at an end of one of the second fixtures. In some embodiments, the plate may be bonded to a patch. In some embodiments, the plate may form a layer of a patch. In some embodiments, the cord ends may be threaded through openings in the plates. Accordingly, the plates may extend around the cord ends. In some embodiments, the plate partially extends around the cord ends. During assembly, the second fixture may anchor a plate such that a cord end may be threaded through the plate. The cord ends may extend from openings in the plates and onto the plates such that the lengths of the ends are fixed. In this way, the final length of extension of the cords from the pit may be fixed. In some embodiments, the cord ends are frayed. The frayed ends may be folded outwards and bonded to the plates. Bonding the plates to patches or patch layers can bond the frayed ends to the same. The plates may have any suitable shape, for example a circular shape, a rectangular shape, or triangular shape. Additionally, in some embodiments, the plates may not extend along the full perimeter around the opening of the plate.

The patch, hollow shell, and plate may comprise the same or different material. For example, the patch may be the same material as the hollow shell. In some embodiments, the patch and the hollow shell may comprise a material of the same material class (e.g., rubber materials). Together, the patch and plate may form a pad such that the plate is a first pad layer and the patch is a second pad layer. An opening may be formed in the hollow shell to allow the cord to extend through such that the cord may be bonded to the first pad layer and/or the second pad layer. In such embodiments, the first pad layer and/or the second pad layer may comprise a larger effective diameter in comparison to the opening to allow an inner side of the first pad layer and/or the second pad layer to bond to the hollow shell.

FIG. 1 shows a ball 100 comprising a suspension system 110 for suspending a pit 140 within a hollow shell 130 according to some embodiments. Ball 100 may be used in sporting activities, such as soccer, basketball, volleyball, rugby, football, tennis, etc. In some embodiments, ball 100 comprises an outer layer 120 and hollow shell 130. In some embodiments, hollow shell 130 may comprise a bladder. In some embodiments, hollow shell 130 may comprise an inflatable bladder. In some embodiments, hollow shell 130 may be arranged within outer layer 120.

In the case of a soccer ball, outer layer 120 may comprise a plurality of panels (e.g., pentagons or hexagons), which are adhered, sewn, or welded together. In some embodiments, a carcass may be arranged between outer layer 120 and hollow shell 130 to reinforce hollow shell 130. In such embodiments, carcass may help prevent damage to hollow shell 130 from external shock, improve the form stability of ball 100, or both. In some embodiments, the carcass may comprise a band or the like being wound around the bladder. In some embodiments, the carcass may be adhered to hollow shell 130.

Hollow shell 130 may comprise an exterior surface 132 and an interior 134. In some embodiments, exterior surface 132 may comprise a suitable coating, e.g., a transparent film, such that hollow shell 130 itself may be used as a ball without needing a separate outer layer, such as outer layer 120. Interior 134 may be a hollow portion, or void, in hollow shell 130. Another exemplary construction of a soccer ball is disclosed in U.S. Pat. No. 6,306,054, the entire disclosure of which is hereby incorporated by reference herein.

Suspension system 110 within hollow shell 130 may serve to locate, support, cushion, and restore position of one or more pits 140 disposed within hollow shell 130, i.e., within interior 134. Pit 140 may be suspended within hollow shell 130 by one or more cords 170. In some embodiments, pit 140 may be suspended within hollow shell 130 by a plurality of cords 170.

Each of the plurality of cords 170 may comprise a first end 172, a center portion 180, and a second end 184. First end 172 and second end 184 may be opposing proximal portions of each cord 170. Center portion 180 may comprise the portion of cord 170 at the center of the length of cord 170, the length measured from the first end 172 to second end 184. In some embodiments, center portion 180 of cord 170 may comprise the portion of cord located at the center point of the length of cord 170.

In some embodiments, each of the plurality of cords 170 may be a continuous cord 170 extending from first end 172 to second end 184. In such embodiments, one continuous cord 170 may thread through ball 100 from hollow shell 130, to pit 140, and back to hollow shell 130. In some embodiments, each of the plurality of cords 170 may comprise a plurality a cord segments joined to form a continuous cord 170 extending from first end 172 to second end 184. In some embodiments, cords 170 may comprise one or more paracords. In some embodiments, cords 170 may be paracords. In some embodiments, cords 170 may comprise nylon. In some embodiments, cords 170 may comprise polyester. In some embodiments, cords 170 may comprise nylon and polyester. In some embodiments, cords 170 may comprise rubber. In some embodiments, cords 170 may comprise KEVLAR® (a para-aramid). In some embodiments, cords 170 may comprise rubber and KEVLAR® molded together.

First end 172 of each respective cord 170 may be coupled to hollow shell 130 at a first location 106. Second end 184 of each respective cord 170 may be coupled to hollow shell 130 at a second location 108 spaced apart from the first location. First locations 106 and second locations 108 where each cord 170 is coupled to hollow shell 130 may be referred to as anchor points for suspending pit 140. In some embodiments, first locations 106 and second locations 108 may be locations on exterior surface 132 of hollow shell 130.

Center portion 180 of each respective cord 170 may be coupled to pit 140. In some embodiments, center portion 180 each respective cord 170 may be coupled to an exterior surface 142 of pit 140. In some embodiments, center portion 180 each respective cord 170 may be coupled to a fastening mechanism located at exterior surface 142 of pit 140.

As discussed herein, hollow shell 130 and cords 170 may provide a suspension system for pit 140. In some embodiments, pit 140 may be suspended such that it is located at a geometrical center of hollow shell 130. In other words, pit 140 may be located at the intersection of a central longitudinal axis 101 and a central lateral axis 103 of hollow shell 130. Pit 140 may be maintained in this central position by one or more cords 170 as described herein.

In some embodiments, each cord 170 may comprise a first cord line 176 extending from exterior surface 142 of pit 140 along a first axis 178. In such embodiments, first cord line 176 may be a linear portion of cord 170 extending along a first axis 178. First cord line 176 may extend to a first location 106 to couple first end 172 of cord 170 to hollow shell 130.

Similarly, each of the plurality of cords 170 may comprise a second cord line 188 extending from exterior surface 142 of pit 140 along a second axis 190. In such embodiments, second cord line 188 may be a linear portion of cord 170 extending along a second axis 190. Second cord line 188 may extend to a second location 108 to couple second end 184 of cord 170 to hollow shell 130.

In some embodiments, an angle ($\alpha$) between first axis 178 and second axis 190 may be between 5 degrees and 90 degrees, between 5 degrees and 60 degrees, or between 5 degrees and 30 degrees. In some embodiments, angle ($\alpha$) may be greater than or equal to 10 degrees. In some embodiments, angle ($\alpha$) may be greater than or equal to 20 degrees. In some embodiments, angle ($\alpha$) may be greater than or equal to 30 degrees. In some embodiments, angle ($\alpha$) may be greater than or equal to 60 degrees. In some embodiments, angle ($\alpha$) may be between 10 degrees and 90 degrees, between 10 degrees and 80 degrees, between 10 degrees and 60 degrees, between 20 degrees and 90 degrees, between 20 degrees and 80 degrees, between 20 degrees and degrees, between 30 and 90 degrees, or between 30 degrees and 80 degrees.

In some embodiments, angle ($\alpha$) may create a desired distance between a spaced apart first location 106 and a second location 108 on hollow shell 130. In some embodiments, angle ($\alpha$) between the first and second axes of for each cord 170 may be selected such that first locations 106 and second locations 108 are spaced equidistantly around the surface area of hollow shell 130.

In some embodiments, the first locations 106 and second locations 108 may be equidistantly spaced apart on hollow shell 130 by a radial distance 109. In such embodiments, radial distance 109 between a particular location (e.g., first location 106 or second location 108) may be spaced apart from its closest radial neighbors (e.g., neighboring first locations 106 and second locations 108) by the same radial distance 109. In this way, each first location 106 (where first end 172 is coupled to hollow shell 130) and each second location 108 (where second end 184 is coupled to hollow shell 130) may be equally spaced apart on ball 100. In some embodiments, distance 109 may be greater than 5 centimeters or greater than 30 centimeters, depending on the diameter of ball 100.

In some embodiments, ball 100 may comprise between two and 15 cords 170, or between five and 10 cords 170. In some embodiments, ball 100 may comprise six cords 170. In general, ball 100 may comprise the same number of cords 170, first locations 106, and second locations 108. For example, ball 100 may comprise six cords 170, six first locations 106 where a first end 172 of each respective cord 170 is coupled to hollow shell 130, and six second locations 108 where a second end 184 of each respective cord 170 is coupled to hollow shell 130.

As discussed herein, cords 170 serve to suspend pit 140 within hollow shell 130 by coupling to both hollow shell 130 and pit 140. In some embodiments, each of a plurality of cords 170 may be coupled to pit 140 to suspend pit 140. In some embodiments, center portions 180 of each of a plurality of cords 170 may be coupled to pit 140.

The center portion 180 of each of the plurality of cords may be coupled to hollow shell 130 at a respective coupling 141. Each coupling 141 may utilize one or more of the following fastening mechanisms to fixedly couple center portion 180 of cord 170 to pit 140.

In some embodiments, the fastening mechanism may comprise an adhesive. In some embodiments, the fastening mechanism may comprise an opening in pit 140. In some embodiments, the fastening mechanism may comprise a void formed in pit 140 by overmolding a portion of the pit 140 on the center portion 180 of the cord 170. In some embodiments, the fastening mechanism may comprise a groove, for example groove 146. In some embodiments, the fastening mechanism may comprise a socket, for example socket 150. In some embodiments, the fastening mechanism may comprise a combination of a groove and a socket, for example groove 146 comprising socket 150. That said, in some embodiments, the fastening mechanism may comprise a groove without a socket, or a socket without a groove. In some embodiments, the fastening mechanism may comprise a clamp or similar frictional fastening device. In some embodiments, the fastening mechanism may comprise a hook.

In some embodiments, the fastening mechanism may comprise an overmolded portion of cord 170 slid into a groove or slot in pit 140. In some embodiments, cord 170 may comprise a crimped portion fit into pit 140 to fasten cord 170 in pit 140. In some embodiments, the fastening mechanism may be fixed to cord 170 and mounted to pit 140. For example, cord 170 may be secured to a U-shaped bracket, the ends of which may be fit into pit 140. In such embodiments, a lock may be fit into pit 140 to secure the ends of the bracket in pit 140, thereby securing cord 170 to pit 140.

In some embodiments, cord 170 may be threaded through openings in pit 140 serving as the fastening mechanism. In such embodiments, cord 170 may include one or more intermediate widened masses (for example knots) positioned within pit 140 between the openings to prevent cord 170 from being released from pit 140. In some embodiments, exterior surface 142 of pit 140 may include one or more cable strain relief mechanisms serving as the fastening mechanism. In such embodiments, cord 170 may be looped in alternate directions around three or more grooves of a strain relief mechanism.

In some embodiments, exterior surface 142 of pit 140 may comprise a fastening mechanism through which cord 170 may be looped. In such embodiments, the fastening mechanisms may be U-shaped brackets having ends secured to pit 140. In some embodiments, a crimp (e.g., a metal crimp) may be secured around cord 170 adjacent the fastening mechanisms to positionally lock cord 170 on pit 140. In some embodiments, an overmolded portion may be formed around cord 170 adjacent the fastening mechanisms to positionally lock cord 170. In some embodiments, a C-clip may be secured around cord 170 adjacent the fastening mechanisms to positionally lock cord 170. In some embodiments, a heat shrink tube may be secured around cord 170 adjacent the fastening mechanisms to positionally lock cord 170.

In some embodiments, each cord 170 may be coupled to pit 140 in the same way, i.e., using the same type of fastening mechanism(s). In some embodiments, different cords 170 may be coupled to pit 140 in different ways, i.e., using different types of fastening mechanisms. For example, one cord 170 may be looped through a groove on exterior surface 142 while another cord 170 may be looped through a structurally distinct groove on exterior surface 142. In another example, one cord 170 may be bonded to exterior surface 142 while another cord 170 may be looped through a groove on exterior surface 142.

In some embodiments, center portion 180 of each of the plurality of cords 170 may be looped through pit 140 to fixedly couple center portions 180 at respective couplings 141. In some embodiments, each of the plurality of cords 170 may be looped through one or more features on exterior surface 142 of pit 140. In some embodiments, each of the plurality of cords 170 may be looped through one or more features on an interior surface 143 of pit 140.

Figure 3:
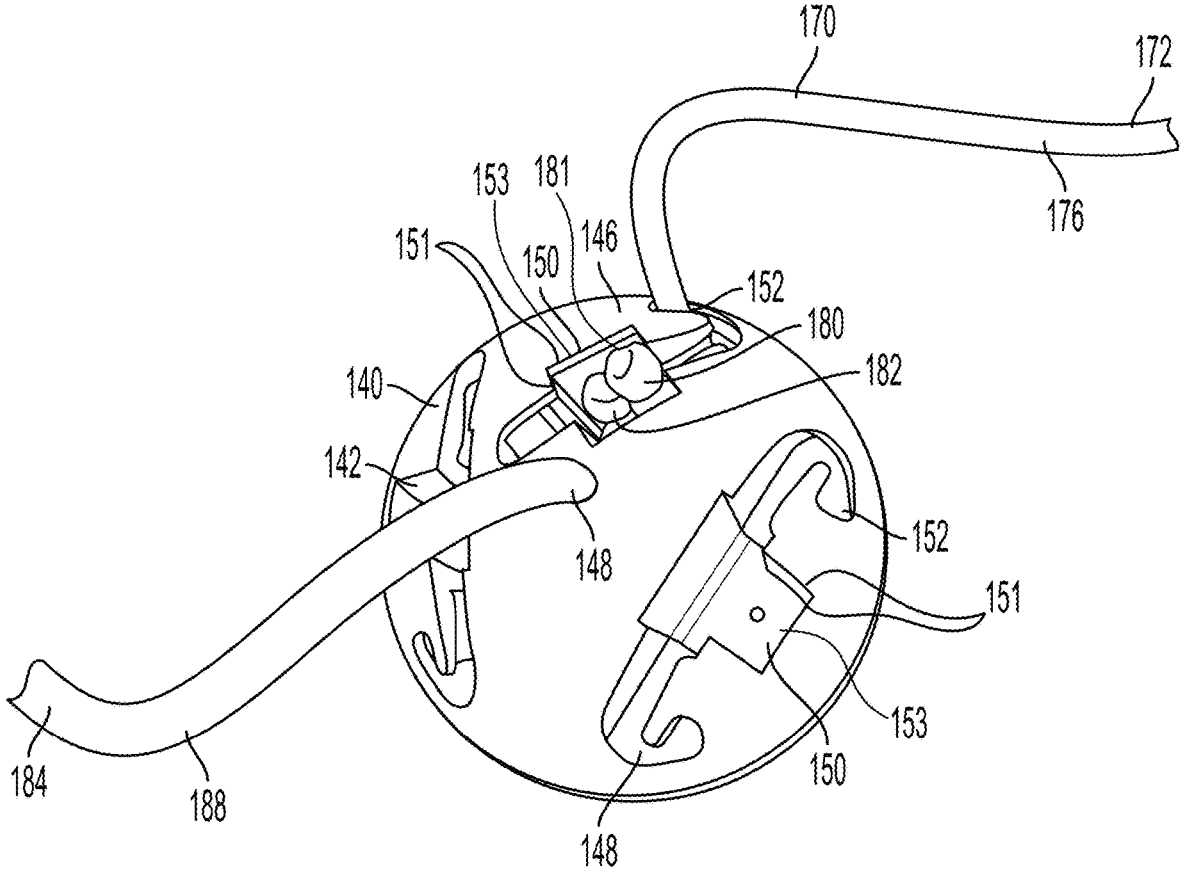
FIG. 3 shows a perspective view of a pit according to some embodiments.

In some embodiments, the one or more features on exterior surface 142 may comprise a groove 146. As shown in FIG. 3, in some embodiments, pit 140 may comprise a plurality of grooves 146. In some embodiments, each of the plurality of grooves 146 may comprise one or more curves. In some embodiments, each of the plurality of grooves 147 may comprise a series of curves through which cord 170 is looped. In some embodiments, each of the plurality of grooves 147 may comprise at least one of a first curve 148, a socket 150, and a second curve 152. In some embodiments, groove 146 may partially extend from exterior surface 142 to an interior 144 of pit 140. In some embodiments, groove 146 may entirely extend from exterior surface 142 to an interior 144 of pit 140. Interior 144 may be a hollow portion, or void, in pit 140.

In some embodiments, groove 146 may extend at least partially from interior surface 143 of pit 140 towards an exterior of pit 140. In such embodiments, at least one of the plurality of cords 170 may be looped through one or more features on interior surface 143 of pit 140. Further, in such embodiments, cord 170 may be threaded through openings in pit 140 to loop through the one or more features on interior surface 143 of pit 140.

In some embodiments, groove 146 may comprise socket 150 on exterior surface 142. In some embodiments, each of the plurality of grooves 146 may comprise first curve 148, second curve 152, and socket 150 connecting first curve 148 and second curve 152. In some embodiments, first curve 148 and second curve 152 may be openings extending from exterior surface 142 to interior 144. In some embodiments, first curve 148, socket 150, and second curve 152 may form an S-shaped groove 146. In some embodiments, first curve 148, socket 150, and second curve 152 may form a hook-shaped groove 146. In some embodiments, pit 140 may comprise one or more S-shaped grooves 146. In some embodiments, pit 140 may comprise one or more hook-shaped grooves 146. In some embodiments, pit 140 may comprise one or more S-shaped grooves 146 and one or more hook-shaped grooves 146.

In some embodiments, socket 150 disposed between first curve 148 and second curve 152 may receive center portion 180 of cord 170. In some embodiments, socket 150 may be a recess on exterior surface 142. In some embodiments, socket 150 may be a channel connecting first curve 148 and second curve 152. In some embodiments, socket 150 may be an enclosed channel. For example, socket 150 may be an enclosed channel formed by overmolding pit 140 on center portion 180 of cord 160. In some embodiments, groove 146 may comprise socket 150 located on interior surface 143 of pit 140. In such embodiments, socket 150 may be a recess on interior surface 143 of pit 140. Further, in such embodiments, cord 170 may be threaded through openings in pit 140 to loop through the socket 150 on interior surface 143 of pit 140.

In some embodiments, socket 150 may comprise a recessed portion 153 and one or more walls 151. In some embodiments, walls 151 may form a sidewall of recessed portion 153. In some embodiments, recessed portion 153 may be surrounded by walls 151. In some embodiments, walls 151 may retain center portion 180 to limit or prevent movement of center portion 180 of cord 170 relative to pit 140. In some embodiments, center portion 180 of each of the plurality of cords 170 may be fixed in recessed portion 153 of a socket 150. In some embodiments, center portion 180 of each of the plurality of cords 170 may comprise a widened mass 181 such that center portion 180 is fixed in socket 150 by an interference or friction fit between mass 181 and socket 150.

In some embodiments, widened mass 181 of center portion 180 of each of the plurality of cords 170 may comprise a knot 182. In such embodiments, knot 182 may be arranged in one of the plurality of grooves 146. In some embodiments, knot 182 may be arranged in one of the plurality of sockets 150 of one of the plurality of grooves 146 located on exterior surface 142 of pit 140.

In some embodiments, widened mass 181 of center portion 180 each of the plurality of cords 170 may comprise a separate piece of material attached to center portion 180. For example, mass 181 may be a piece of plastic or metal molded onto center portion 180 of cord 170. In such embodiments, the separate piece may be arranged in one of the plurality of grooves 146. In some embodiments, the separate piece may be arranged in one of the plurality of sockets 150 of one of the plurality of grooves 146 located on exterior surface 142 of pit 140.

In some embodiments, groove 146 may comprise one or more features to facilitate fixing center portion 180 of cord 170. For example, in some embodiments, groove 146 may comprise barbs. In some embodiments, first curve 148 and second curve 152 may comprise barbs to anchor cord 170 in groove 146. As another example, in some embodiments, groove 146 may comprise one or more hooks. In some embodiments, center portion 180 may loop onto the hook(s) in groove 146 to facilitate interlocking center portion 180 to pit 140. As another example, in some embodiments, groove 146 may comprise a plurality of curves through which center portion 180 can be wound to fixedly couple center portion 180 to pit 140.

In some embodiments, center portion 180 of each of the plurality of cords 170 may be looped through one of the plurality of grooves 146 located on exterior surface 142 of pit 140. In such embodiments, cord 170 may extend into pit 140 from socket 150 and respectively exit pit 140 at first curve 148 and second curve 152 of groove 146. Opposing portions of the cord 170 may then extend to hollow shell 130 (for example, along axes 178 and 190 as shown in FIG. 1) to a first location 106 and a second location 108, respectively. In this way, continuous cord 170 may thread through ball 100 from hollow shell 130, to pit 140, and back to hollow shell 130.

In some embodiments, a plurality of continuous cords 170 may thread through ball 100 from hollow shell 130, to one of a plurality of grooves 146 on pit 140, and back to hollow shell 130. In such embodiments, each of the plurality of cords 170 may extend to a respective first location 106 on hollow shell 130 from first curve 148 of one of the plurality of grooves 146. A mass of center portion 180 (e.g., knot 182) of each of the plurality of cords 170 may be arranged in one of the plurality of sockets 150 of one of the plurality of grooves 146. Finally, each of the plurality of cords 170 may extend to a respective second location 108 on hollow shell 130 from second curve 152 of one of the plurality of grooves 146.

In some embodiments, pit 140 may provide a central mass to ball 100. In some embodiments, pit 140 may comprise a mass of less than or equal to 50 grams. In some embodiments, pit 140 may comprise a mass of less than or equal to 30 grams. In some embodiments, pit 140 may comprise a mass between 22 grams and 26 grams, such as 24 grams. In some embodiments, ball 100 may comprise a mass between 410 grams and 450 grams.

Figure 4:
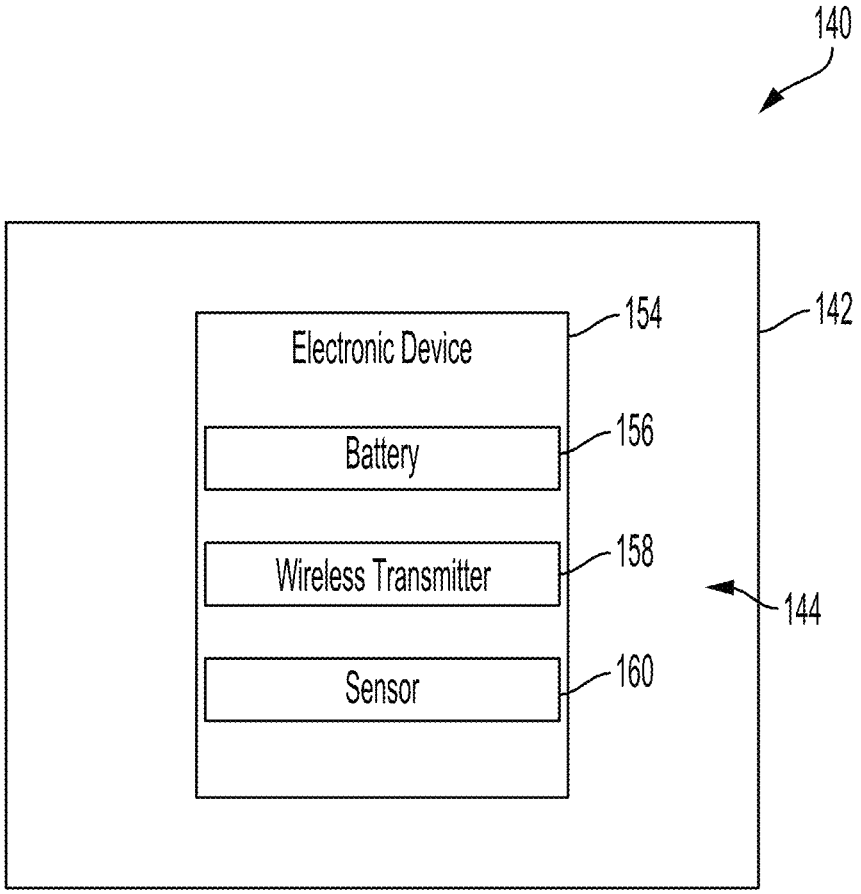
FIG. 4 shows a schematic diagram of the pit according to some embodiments.

In some embodiments, pit 140 is simply a center mass with no other function. In other embodiments, pit 140 may comprise one or more functional components. For example, as shown in FIG. 4, pit 140 may comprise one or more electronic devices 154. In some embodiments, electronic device 154 may comprise a battery 156 and a wireless transmitter 158. In some embodiments, electronic device 154 may comprise one or more sensors 160. Sensors 160 may be powered by battery 156. Sensors 160 may collect information regarding various parameters of a sporting activity. In some embodiments, the information may comprise the position of the ball 100 at any time during the sporting activity, parameters of ball 100, such as a velocity and a position of ball 100, and/or the performance of individual players. In some embodiments, sensors 160 may be a pressure sensor, a global positioning system sensor, an accelerometer, a magnetometer, a gyroscope, a hall sensor, a temperature sensor, a cellular phone module, or a combination thereof. In some embodiments, wireless transmitter 158 may transmit information collected by sensors 160 to one or more external devices (e.g., smartphones or computers).

In some embodiments, pit 140 may protect electronic device 154 from damage. For example, pit 140 may comprise a stiff material, such as a lightweight but rigid plastic material, to provide protection for the sensitive components of electronic device 154. Suitable plastic materials comprise, for example, thermoplastic urethane (TPU) and acrylnitrile-butadiene-styrole (ABS). In some embodiments, including a carcass may additionally or alternatively facilitate protection of electronic device 154. For example, carcass may reinforce a bladder of hollow shell 130, which may increase the stability of electronic device 154 suspended in interior 134 of hollow shell 130. In some embodiments, interior 134 may be filled by a gas having a particularly high pressure, to limit deformation of ball 100, thereby increasing the stability of electronic device 154 suspended in interior 134. Stability of electronic device 154 may be achieved by minimizing or preventing movement of electronic device 154 in interior 134. In some embodiments, stability of electronic device 154 may be achieved by maintaining pit 140 at the intersection of central longitudinal axis 101 and central lateral axis 103 of hollow shell 130.

In some embodiments, pit 140 may be sealed around electronic device 154. In this way, pit 140 may contain electronic device 154. In some embodiments, pit 140 and electronic device 154 may be assembled together and separately from hollow shell 130 and cords 170. In some embodiments, pit 140 and electronic device 154 may be assembled together with cords 170.

Figure 5:
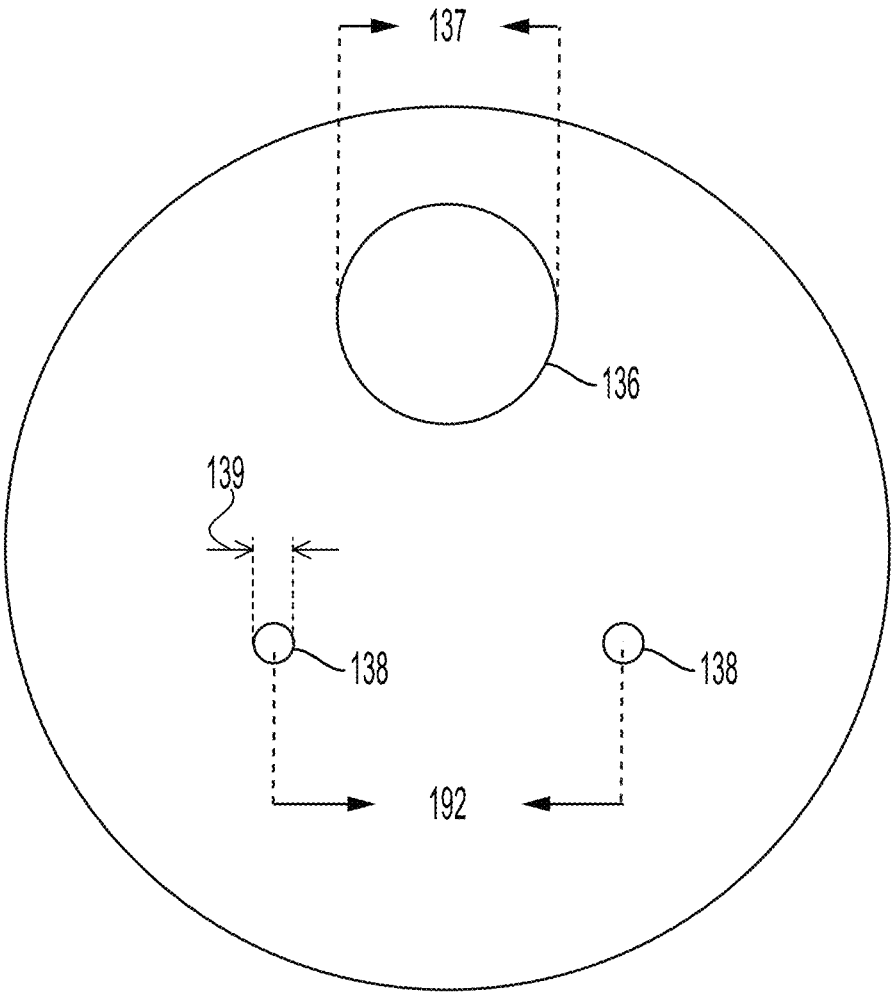
FIG. 5 shows a hollow shell of the ball of FIG. 1 according to some embodiments.
Figure 6:
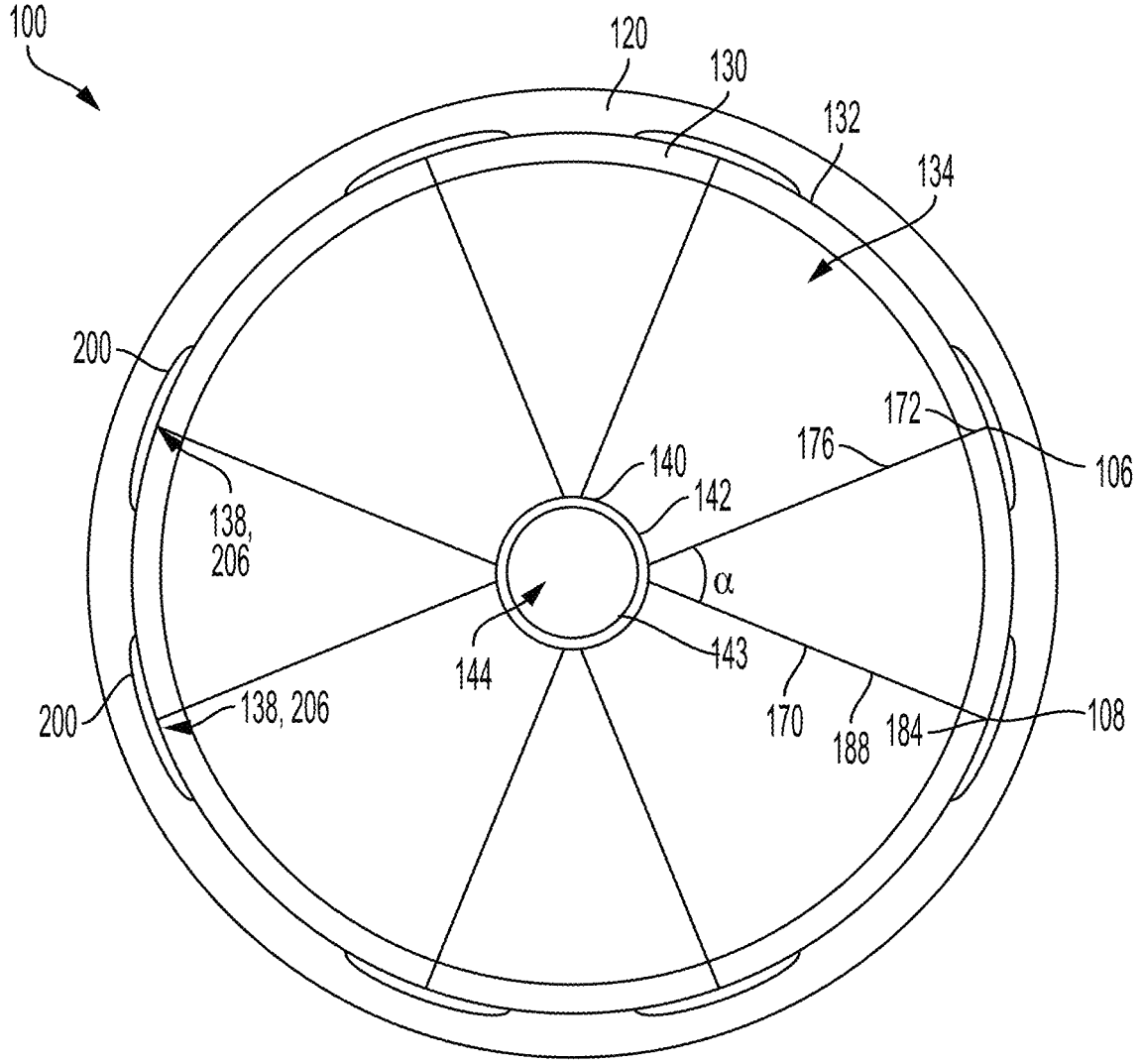
FIG. 6 shows a ball according to some embodiments.

With reference to FIGS. 5 and 6, in some embodiments, to assemble pit 140 with hollow shell 130, hollow shell 130 may comprise one or more first openings 136. First opening(s) 136 may be a hole cut in hollow shell 130 to allow for pit 140 to be disposed in interior 134 of hollow shell 130.

The term "effective diameter" as used herein is a non-limiting term to describe the size of a component, but this term should not be interpreted as requiring the component to have a circular diameter or shape. Instead, the component may have a non-circular shape, and in such embodiments, the term "effective diameter" is intended to refer to the maximum cross-sectional dimension of the shape. For example, the "effective diameter" of a component having an elliptical cross-sectional shape would be the length of the major axis of the elliptical shape. An "effective radius" is defined as half of an effective diameter.

In some embodiments, hollow shell 130 may comprise one or more second openings 138. Second opening(s) 138 may be a hole cut in hollow shell 130 to allow for cords 170 to extend from interior 134 of hollow shell 130 through exterior surface 132. In some embodiments, second opening 138 may comprise an effective diameter 139. In some embodiments, the effective diameter of second opening(s) 138 may be smaller than the effective diameter of first opening(s) 136. In some embodiments, the effective diameter of second opening(s) 138 may be the same as an effective diameter of cords 170.

In some embodiments, two second openings 138 may respectively receive first end 172 and second end 184 of cord 170. In this way, two second openings 138 may coincide with first location 106 and second location 108 where the first and second free ends of each of the plurality of cords 170 are coupled to hollow shell 130. In such embodiments, two second openings 138 may coincide with the anchor points where first ends 172 are coupled to hollow shell 130 and second ends 184 coupled to hollow shell 130.

In some embodiments, second openings 138 may be equidistantly spaced apart on hollow shell 130 by a radial distance 192. In such embodiments, radial distance 192 between a particular second opening 138 may be spaced apart from its closest radial neighboring second openings 138 by the same radial distance 192. In this way, each second opening 138 may be equally spaced apart on ball 100. In some embodiments, distance 192 may be greater than five centimeters or greater than 30 centimeters, depending on the diameter of the ball 100. In some embodiments, distance 192 may be equal to distance 109.

Cords 170 may be coupled to hollow shell 130 at first locations 106 and second locations 108 by coupling first end 172 of a respective cord 170 at a first location 106 and coupling second end 184 of the respective cord 170 at a second location 108. First and second ends 172/184 of cord 170 may be coupled to first location 106 and second location 108 such that the first and second ends are fixed at first location 106 and second location 108 respectively. In other words, first location 106 and second location 108 may be anchor points for suspending pit 140.

Ends 172 and 184 of cords 170 may be coupled to hollow shell 130 using one or more of the following mechanisms that fixedly couple the first and second ends 172/184 to first and second locations 106/108, respectively, on hollow shell 130. In some embodiments, ends 172 and 184 of cord 170 may be coupled to hollow shell 130 with an adhesive. In some embodiments, ends 172 and 184 of cord 170 may be coupled to hollow shell 130 by directly bonding ends 172/184 to hollow shell 130, for example by heat bonding ends 172/184 to hollow shell 130. In some embodiments, ends 172/184 of cord 170 may be coupled to hollow shell 130 by adhesively bonding (gluing) first end 172 and second end 184 to one or more layers of one or more pads 200. In some embodiments, ends 172/184 of cord 170 may be coupled to hollow shell 130 with by stitching ends 172/184 to hollow shell 130. In some embodiments, ends 172/184 of cord 170 may be coupled to hollow shell 130 by clamping ends 172/184 of cord 170 to hollow shell 130. In some embodiments, first end 172 and second end 184 may be coupled to hollow shell 130 in the same way. For example, both first end 172 and second end 184 may be adhesively bonded to hollow shell 130. In other embodiments, first end 172 and second end 184 may be coupled to hollow shell 130 in different ways. For example, first end 172 may be stitched to hollow shell 130 while second end 184 is adhesively bonded to hollow shell 130.

In some embodiments, first and second ends 172/184 of cord 170 may be coupled to an interior surface of hollow shell 130 at first and second locations 106 and 108, respectively. In some embodiments, cords 170 may extend to exterior surface 132 of hollow shell 130. In such embodiments, first end 172 of cord 170 may be coupled to exterior surface 132 of hollow shell 130 at a first location 106 and second end 184 of cord 170 may be coupled to exterior surface 132 of hollow shell 130 at a second location 108.

In some embodiments, first and second ends 172/184 of cord 170 may be coupled to first location 106 and second location 108, respectively, with separate pads 200 bonded to hollow shell at first location 106 and second location 108. In such embodiments, a first location 106 may comprise a first pad 200 and a second location 108 may comprise a second pad 200.

In some embodiments, pads 200 may be adhesively bonded to hollow shell 130. In some embodiments, pads 200 may be directly bonded to hollow shell 130, for example by heat bonding pads 200 to hollow shell 130. In some embodiments, pads 200 may be bonded to an interior surface of hollow shell 130. In some embodiments, pads 200 may be bonded to exterior surface 132 of hollow shell 130. In such embodiments, two second openings 138 may respectively receive first end 172 and second end 184 of a cord 170. In this way, two second openings 138 may coincide with first location 106 and second location 108 where each of the plurality of cords 170 extend to hollow shell 130.

As shown, for example in FIG. 6, first end 172 and second end 184 may extend through second openings 138 to couple with pads 200. In some embodiments, pads 200 may cover and seal second openings 138 in hollow shell 130. In such embodiments, the seal may be an airtight seal.

Figure 7A:
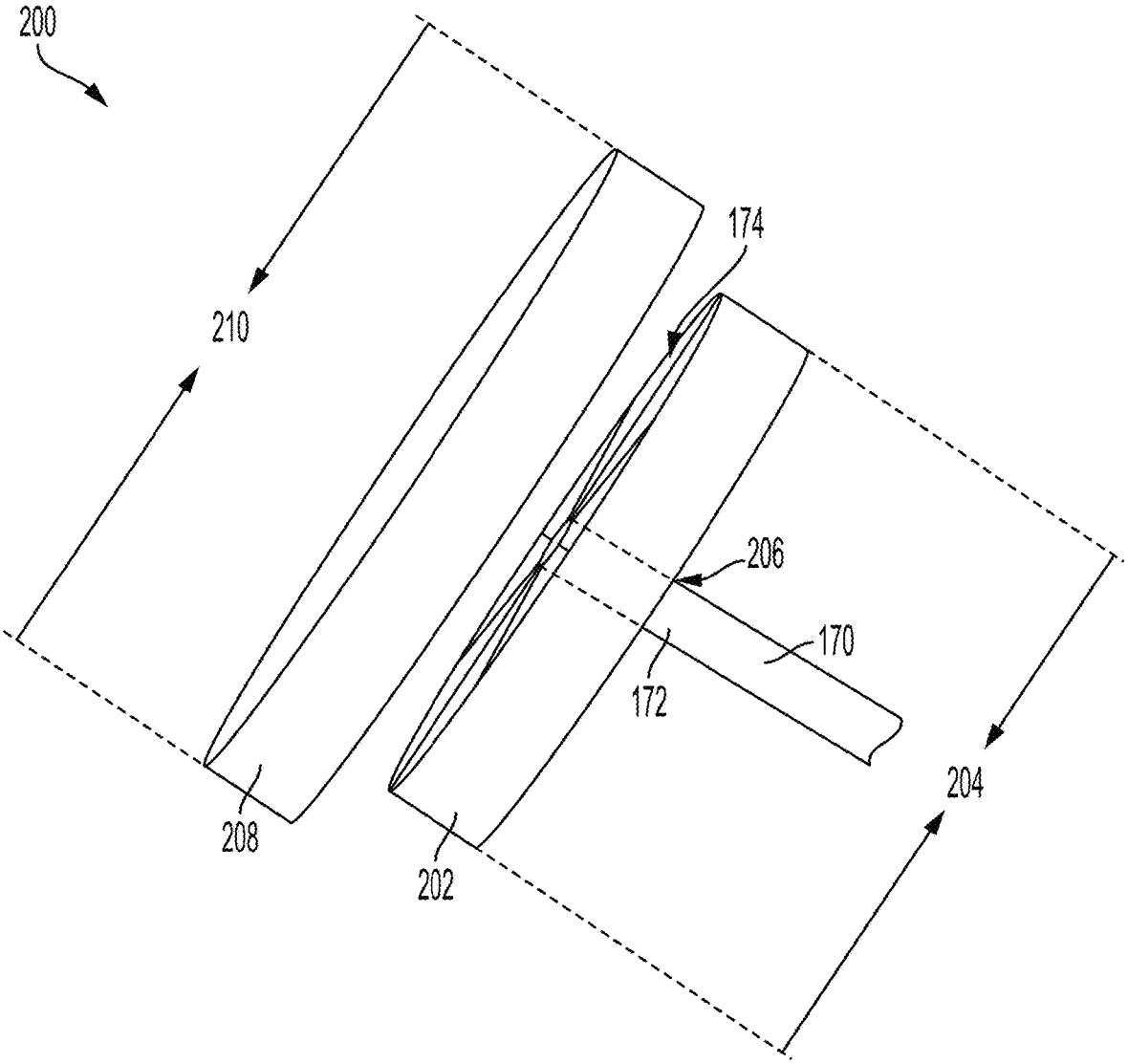
FIG. 7A shows a perspective view of a pad according to some embodiments.

With reference to FIGS. 6 and 7A, in some embodiments, pads 200 may have an effective diameter 210. In some embodiments, effective diameter 210 may be between five millimeters and 40 millimeters, between 10 millimeters and 40 millimeters, or between 20 millimeters and 40 millimeters. In some embodiments, effective diameter 210 may be larger than effective diameter 139 of second opening 138.

In some embodiments, first end 172 and second end 184 may extend through second openings 138 and between two pad layers defining pad 200. In such embodiments, first end 172 and second end 184 may be secured to pads 200 by sandwiching first end 172 and second end 184 between a first pad layer and a second pad layer of pads 200.

For example, in some embodiments, pad 200 may comprise a first pad layer 202 and a second pad layer 208, as shown in FIG. 7A. In some embodiments, first pad layer 202 and second pad layer 208 are bonded together to form pad 200. In some embodiments, pad 200 comprises only first pad layer 202. In some embodiments, pad comprises only second pad layer 208.

In some embodiments, first pad layer 202 may comprise one or more openings 206 to allow a first end 172 or a second end 184 to extend through first pad layer 202. In other words, first pad layer 202 may comprise opening 206 through which first end 172 or second end 184 of a cord 170 may be received.

In some embodiments, first pad layer 202 may have an effective diameter 204 between 10 millimeters and 50 millimeters, between 15 millimeters and 35 millimeters, or between 15 millimeters and 25 millimeters. In some embodiments, effective diameter 204 may be smaller than effective diameter 210 of pad 200. In some embodiments, effective diameter 204 may be the same as effective diameter 210.

In embodiments including first pad layer 202 and second pad layer 208, effective diameter 210 of pad 200 may be the effective diameter of second pad layer 208. In some embodiments, second pad layer 208 may comprise an effective diameter 210 greater than the effective diameter 204 of first pad layer 202.

With reference to FIGS. 6 and 7A, in some embodiments, effective diameter 210 of second pad layer 208 may be greater than effective diameter 204 of first pad layer 202 to facilitate attachment between pad 200 and hollow shell 130. For example, because effective diameter 210 is larger than effective diameter 139 of second openings 138, pad 200 may be attached to hollow shell 130 over second opening 138. In such embodiments, second pad layer 208 may be a patch that covers and seals second opening 138. In some embodiments, effective diameter 210 may be at least two millimeters greater than effective diameter 204.

In some embodiments, second pad layer 208 and hollow shell 130 may comprise the same material. In some embodiments, second pad layer 208 and hollow shell 130 comprise different materials. In some embodiments, second pad layer 208 comprises a stiffer material than hollow shell 130. In some embodiments, second pad layer 208 comprises the same material as hollow shell 130, but is thicker such that it is stiffer than hollow shell 130. In some embodiments, first pad layer 202, second pad layer 208, and hollow shell 130 may comprise the same material. In some embodiments, first pad layer 202 and second pad layer 208 may comprise a different and/or stiffer material than hollow shell 130. In some embodiments, first pad layer 202, second pad layer 208, and hollow shell 130 may comprise a material of the same material class (e.g., rubber materials).

In some embodiments, pads 200 may receive cords 170. In some embodiments, ends 172 and 184 of cords 170 may be sized to fit through openings 206. In some embodiments, ends 172 and 184 of cords 170 may attach to first pad layers 202. In some embodiments, ends 172 and 184 of cords 170 may be bent outwardly and bonded to first pad layers 202 after being threaded through openings 206. In some embodiments, ends 172 and 184 of cords 170 may lay flat on first pad layer 202. In such embodiments, flat ends 172 and 184 may be adhesively or directly bonded to first pad layers 202. In some embodiments, flat ends 172 and 184 of cords 170 may be portions of cords 170 molded into a flat shape.

In some embodiments, flat ends 172 and 184 of cords 170 may be frayed portions of cords 170 lying flat on first pads 202. In some embodiments, cords 170 may be fibrous cords and flat ends 172 and 184 of cords 170 may be frayed fiber portions of cords 170 lying flat on first pads 202. In some embodiments, to attach fibrous cords 170 to first pad layers 202, fibrous cords 170 may be twisted outwardly at first end 172 and second end 184. Accordingly, first end 172 may comprise a first frayed end 174. Similarly, second end 184 may comprise a second frayed end 186 (as shown for example in FIG. 8). In some embodiments, first frayed end 174 may be bonded to a first pad layer 202, second frayed end 186 may be bonded to a first pad layer 202, or both.

In some embodiments, each of the plurality of cords 170 comprises one or more frayed ends. First end 172 of cord 170 may comprise a first frayed end 174, second end 184 of cord 170 may comprise a second frayed end 186, or both. The frayed ends of each cord 170 may be secured to hollow shell 130 at one of a plurality of spaced apart locations. For example, first frayed end 174 may be secured to a first location 106. Similarly, second frayed end 186 may be secured to a second location 108. In some embodiments, the spaced apart locations each comprise a pad 200 bonded to hollow shell, for example bonded to exterior surface 132 of hollow shell 130. In some embodiments, the frayed end of each cord 170 may be bonded to a pad 200 at each respective spaced apart location.

In some embodiments, at least first frayed end 174 of first end 172 may be attached to a first pad layer 202. Similarly, in some embodiments, at least second frayed end 186 of second end 184 may be attached to a first pad layer 202.

In some embodiments, first frayed end 174 and second frayed end 186 may bond to both first pad layer 202 and second pad layer 208. In some embodiments, first frayed end 174 may be sandwiched between first pad layer 202 and second pad layer 208. Similarly, second frayed end 186 may be sandwiched between first pad layer 202 and second pad layer 208.

Figure 7B:
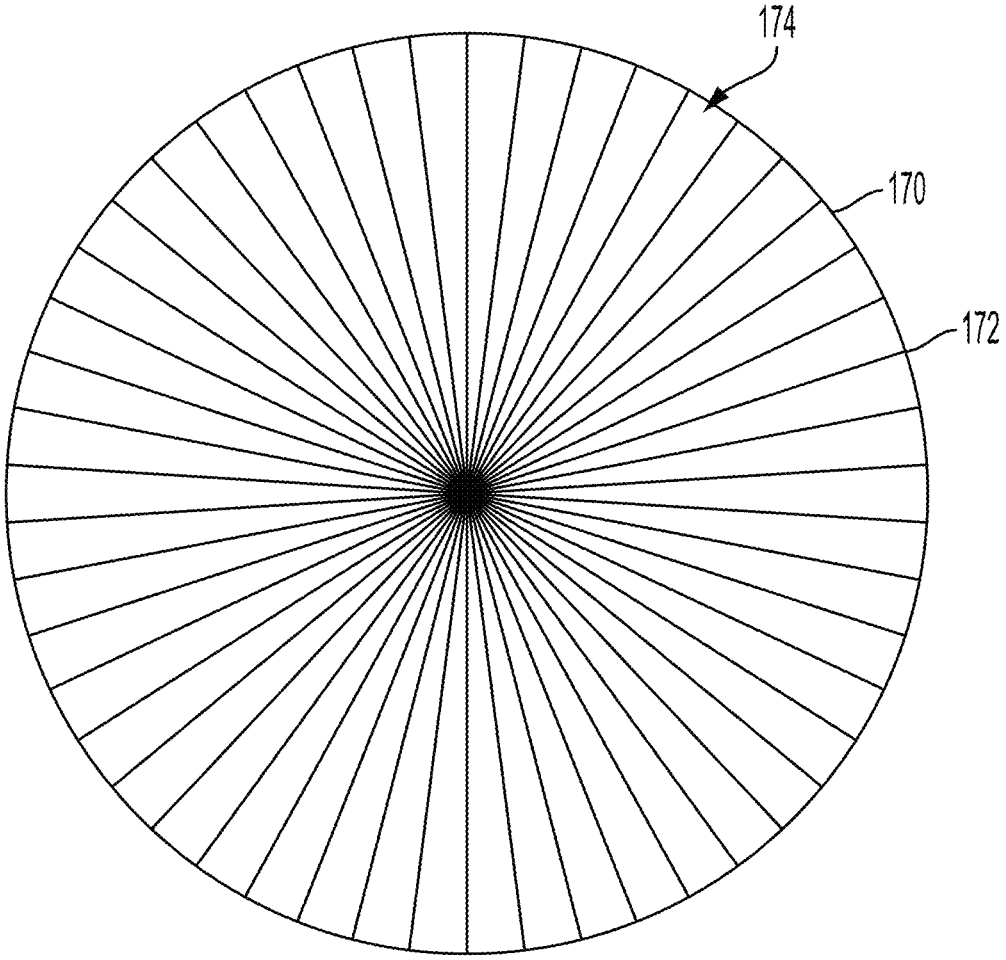
FIG. 7B shows a plan view of the pad of FIG. 7A.

With reference to FIGS. 7A and 7B, in some embodiments, frayed fibers of first frayed end 174 may extend radially on a first pad layer 202. In some embodiments, frayed fibers of first frayed end 174 may extend radially from opening 206 of a first pad layer 202. In some embodiments, frayed fibers of second frayed end 186 may extend radially on first pad layer 202. In some embodiments, frayed fibers of second frayed end 186 may extend radially from opening 206 of a first pad layer 202. In some embodiments, frayed fibers of first frayed end 174 may have a length of greater than or equal to 10 millimeters, greater than or equal to 8 millimeters, or greater than or equal to 5 millimeters. In some embodiments, frayed fibers of second frayed end 186 may have a length of greater than or equal to 10 millimeters, greater than or equal to 8 millimeters, or greater than or equal to 5 millimeters.

In some embodiments, suspension system 110 for pit 140 may be manufactured without turning hollow shell 130 inside out. In some embodiments, pit 140 and cords 170 may be assembled together before being disposed within hollow shell 130. In some embodiments, pit 140 and cords 170 may be inserted into hollow shell 130 via first opening 136.

Figure 8:
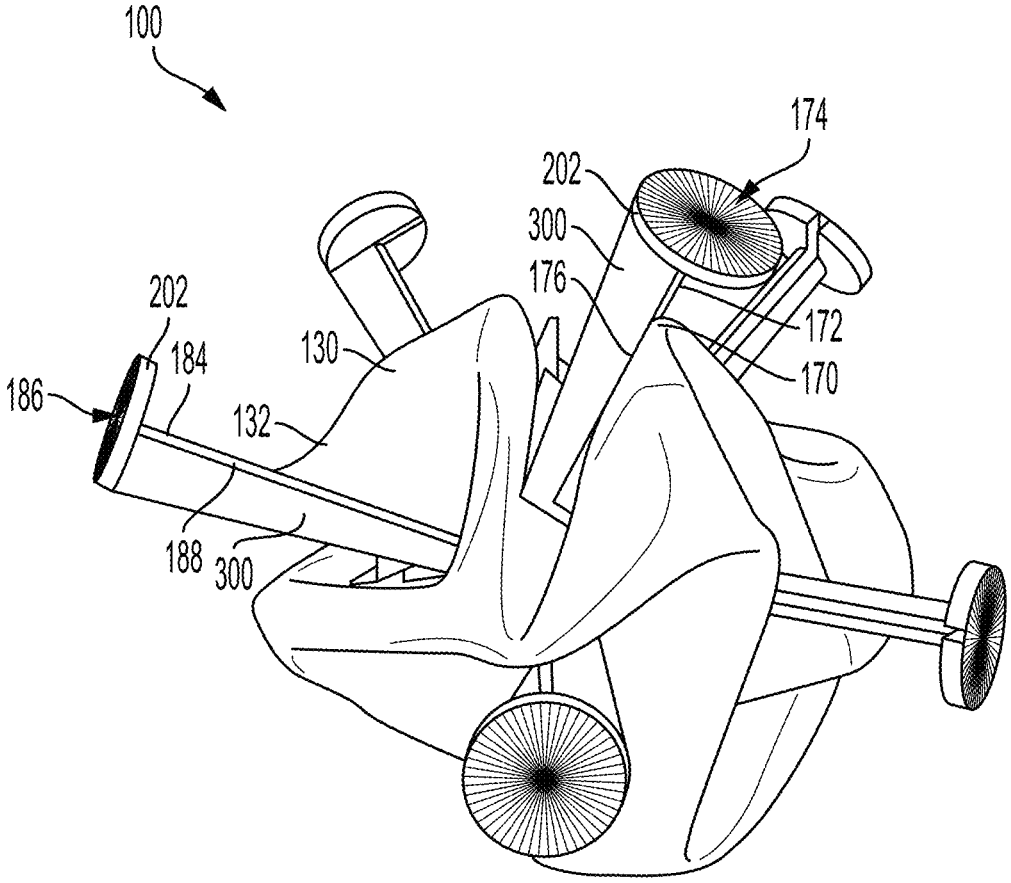
FIG. 8 shows a perspective view of the ball of FIG. 1 during a method of manufacturing the ball according to some embodiments.

As shown for example in FIG. 8, in some embodiments, once pit 140 and cords 170 are inserted into hollow shell 130, cords 170 may be cut to length. In some embodiments, each of first end 172 and second end 184 may be cut to the same length. Accordingly, first end 172 and second end 184 may extend from pit 140 to the same distance.

In some embodiments, a fixture may be used to define a cutting length of first end 172 and second end 184. In such embodiments, cord 170 may be secured to the fixture, such as by a clamp. In some embodiments, a second fixture 300 may be used to bond cord 170 to first pad layer 202. Second fixture 300 may be used to bond first cord end 172 and second cord end 184 to pads 200. In some embodiments, first pad layer 202 may be arranged at an end of a second fixture 300.

In some embodiments, first pad layer 202 may be a plate that supports first cord end 172 or second cord end 184. In such embodiments, the support from first pad layer 202 may facilitate attachment to second pad layer 208. Accordingly, cord 170 may be fixed in position by extending onto first pad layer 202. For example, cord 170 may be frayed, folded, or a combination thereof, at first cord end 172 and second cord end 184 on first pad layers 202 as described herein. In some embodiments, first cord end 172 and second cord end 184 may extend through openings 206 of first pad layers 202 and onto first pad layers 202. First pad layer 202 being a plate may extend partially or entirely around openings 206, and therefore first cord end 172 or second cord end 184. First pad layer 202 may be bonded to second pad layer 208 to form pad 200. In some embodiments, first cord end 172 and second cord end 184 may extend from openings 206 in first pad layers 202 and onto first pad layers 202 such that the lengths of first cord end 172 and second cord end 184 are fixed. In this way, the final length of extension of the cords from the pit may be fixed, i.e., the final extension of first cord line 176 and second cord line 188 from pit 140 to hollow shell 130 may be fixed.

Figure 9:
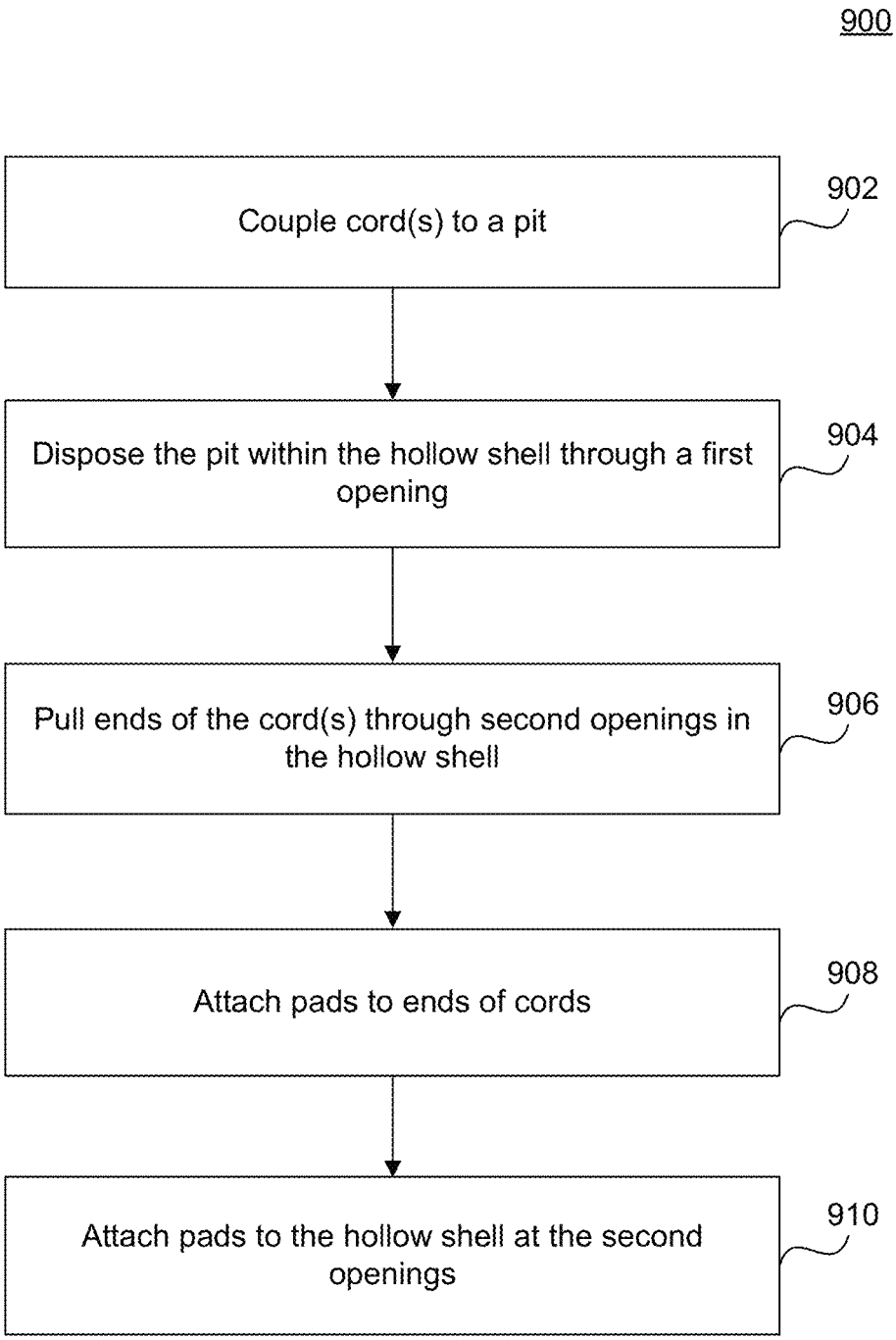
FIG. 9 shows a method of manufacturing the ball of FIG. 1 according to some embodiments.

FIG. 9 shows an exemplary method 900 of making ball 100 according to embodiments. In some embodiments, method 900 may comprise a step 902, during which one or more cords are coupled 170 to pit 140. In some embodiments, a plurality of cords 170 may be coupled to pit 140. Each cord 170 may be coupled to pit 140 in step 902 using one or more of the fastening mechanisms described herein.

In some embodiments, method 900 may comprise step 904, during which pit 140 is disposed within hollow shell 130 through first opening 136. In some embodiments, hollow shell 130 may comprise first opening 136 and a plurality of second openings 138 through which first ends 172 and second ends 184 of cords 170 are threaded in step 906.

In some embodiments, method 900 may comprise step 908, during which first ends 172 and second ends 184 of cords 170 are attached to pads 200. In such embodiments, pads 200 attached to first ends 172 may be attached to hollow shell 130 at second openings 138 in step 910. Similarly, in step 910, pads 200 attached to second ends 184 may be attached to hollow shell 130 at second openings 138. In some embodiments, pads 200 may be bonded to hollow shell 130 at second openings 138 in step 910. In some embodiments, pads 200 may be bonded to hollow shell 130 such that second openings 138 are sealed in step 910.

Figure 10:
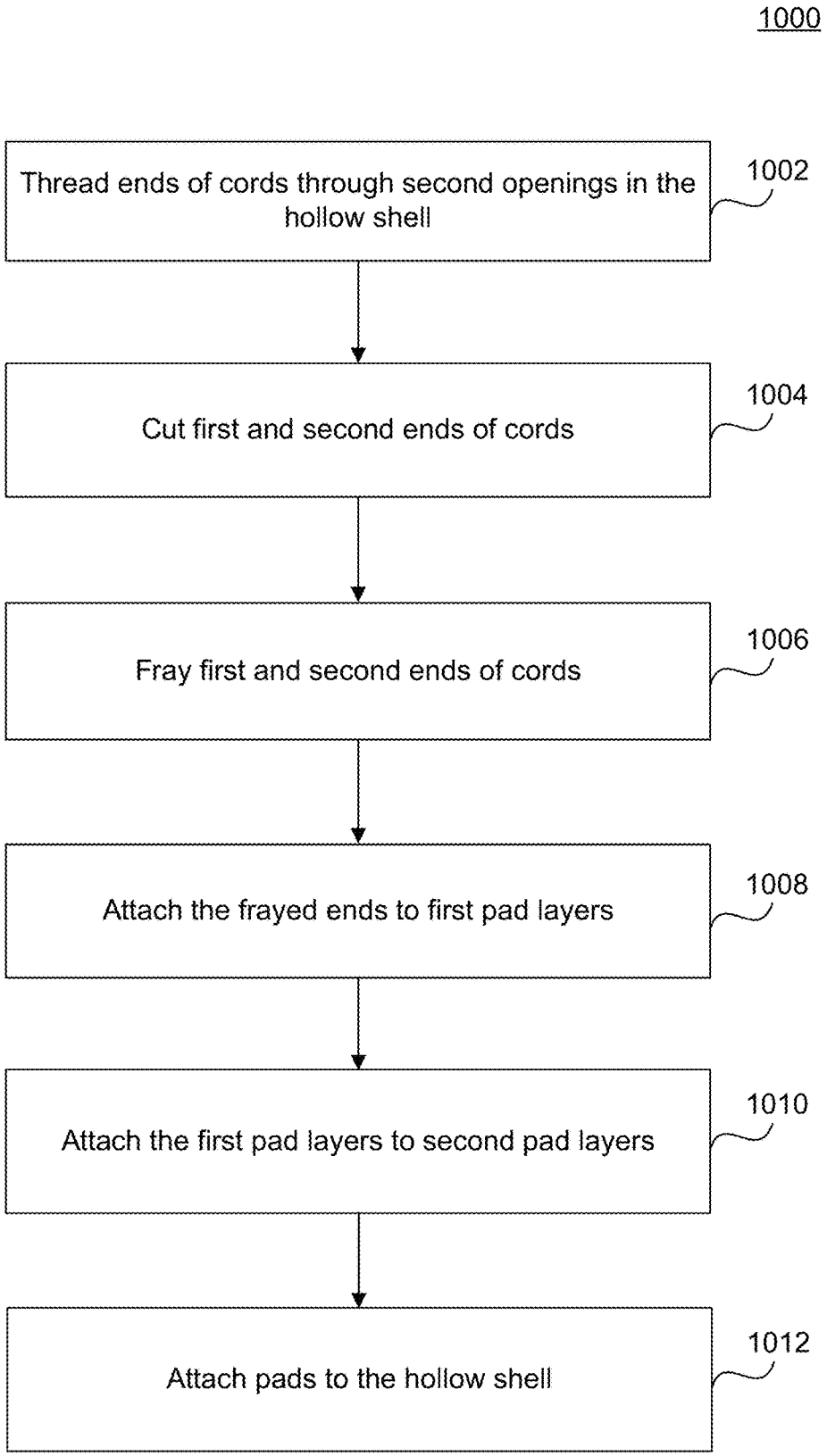
FIG. 10 shows a method of manufacturing the ball of FIG. 1 according to some embodiments.

FIG. 10 shows an exemplary method 1000 of coupling ends 172 and 184 of cords to hollow shell 130 to make ball 100 according to some embodiments. First, in step 1002, first ends 172 and second ends 184 of a plurality of cords 170 may be threaded through second openings 138 in hollow shell 130. In some embodiments, first ends 172 and second ends 184 may be threaded through respective second openings 138 such that each cord 170 comprises a first cord line 176 extending from exterior surface 142 of pit 140, and a second cord line 188 extending from exterior surface 142 of pit 140.

Next, in step 1004, first cord lines 176 are cut to length and second cord lines 188 are cut to length. In some embodiments, the length of first cord lines 176 and second cord lines 188 are the same. In some embodiments, step 1004 may be performed before step 1002.

Next, in step 1006, first ends 172 of cords 170 are frayed to form first frayed ends 174 and second ends 184 of cords 170 are frayed to form second frayed ends 186. In some embodiments, fraying first ends 172 and second ends 184 may comprise twisting cords 170 open at first ends 172 and second ends 184.

Next, in step 1008, first ends 172 and second ends 184 may be attached to pads 200. In some embodiments, attaching first ends 172 and second ends 184 may comprise gluing first frayed ends 174 and second frayed ends 186 to pads 200 with an adhesive. In some embodiments, the adhesive may be a rubber adhesive. In some embodiments, step 1008 may comprise attaching first frayed ends 174 and second frayed ends 186 to first pad layers 202. In some embodiments, attaching first frayed ends 174 and second frayed ends 186 to first pad layers 202 may comprise gluing ends 174 and 186 to first pad layers 202 with an adhesive. In some embodiments, the adhesive may be a rubber adhesive.

Next, in step 1010, first pad layers 202 may be attached to second pad layers 208 to form pads 200. In some embodiments, first pad layers 202 and second pad layers 208 may be attached with an adhesive. In some embodiments, the adhesive may be a rubber adhesive. In some embodiments, attaching first pad layers 202 and second pad layers 208 sandwiches frayed ends 174 and 186 between respective first pad layers 202 and second pad layers 208 of each pad 200.

Next, in step 1012, pads 200 are attached to hollow shell 130. In some embodiments, attaching pads 200 to hollow shell 130 may comprise bonding pads 200 to hollow shell 130 with an adhesive. In some embodiments, the adhesive may be a rubber adhesive. In some embodiments, attaching pads 200 to hollow shell 130 may comprise applying heat and pressure to cure adhesive used in method 1000. In embodiments comprising rubber adhesive, applying heat and pressure can vulcanize the rubber adhesive. In some embodiments, heat and pressure may be applied while ball 100 is in a mold. In some embodiments, step 1012 may comprise applying a temperature of about 160 degrees Celsius for about three minutes with about six kilograms of pressure.

The breadth and scope of the present disclosure should not be limited by any of the above-described exemplary embodiments, but should be defined only in accordance with the following claims and their equivalents. It is to be understood that the phraseology or terminology herein is for the purpose of description and not of limitation, such that the terminology or phraseology of the present specification is to be interpreted by the skilled artisan in light of the teachings and guidance.

What is claimed is:

1. A sports ball, comprising:

a hollow shell; and a pit suspended within the hollow shell by a plurality of cords, wherein each of the plurality of cords comprises:

a first cord line extending from the pit along a first axis to a first end coupled to the hollow shell at a first location, a second cord line extending from the pit along a second axis to a second end coupled to the hollow shell at a second location, and a center portion coupled to the pit, wherein an angle between the first axis and the second axis is greater than or equal to 5 degrees and less than or equal to 90 degrees.

2. The sports ball of claim 1, wherein the first location comprises a first pad bonded to an exterior surface of the hollow shell, and wherein the second location comprises a second pad bonded to the exterior surface of the hollow shell.

3. The sports ball of claim 2, wherein each of the plurality cords is a fibrous cord, wherein the first end of one of the plurality of cords comprises frayed fibers of the cord, and wherein the frayed fibers are bonded to the first pad.

4. The sports ball of claim 3, wherein the first pad comprises a first pad layer and a second pad layer, and wherein the frayed fibers are sandwiched between the first pad layer and the second pad layer.

5. The sports ball of claim 4, wherein the first pad layer comprises an opening through which the first end of the cord comprising the frayed fibers is received.

6. The sports ball of claim 4, wherein the first pad layer comprises a first effective diameter, and wherein the second pad layer comprises a second effective diameter greater than the first effective diameter.

7. The sports ball of claim 1, wherein the center portion of each of the plurality of cords is looped through the pit.

8. The sports ball of claim 1, wherein the center portion of each of the plurality of cords is looped through one of a plurality of grooves located on an exterior surface of the pit.

9. The sports ball of claim 8, wherein each of the plurality of grooves comprises a first curve, a second curve, and a socket connecting the first curve and the second curve.

10. The sports ball of claim 9, wherein each of the plurality of cords extends to a respective one of the first locations from the first curve of one of the plurality of grooves, and wherein each of the plurality of cords extends to a respective one of the second locations from the second curve of one of the plurality of grooves.

11. The sports ball of claim 1, wherein the pit comprises a plurality of sockets, each of the sockets comprising a recessed portion surrounded by a wall, and wherein the center portion of each of the plurality of cords is fixed in the recessed portion of one of the sockets.

12. The sports ball of claim 1, wherein the first locations and the second locations are spaced equidistantly around a surface area of the hollow shell.

13. The sports ball of claim 1, wherein each of the plurality of cords is a continuous cord extending from the first end to the second end.

14. The sports ball of claim 1, wherein the pit comprises an electronic device.

15. The sports ball of claim 14, wherein the electronic device comprises a battery and a wireless transmitter.

16. The sports ball of claim 14, wherein the electronic device comprises a sensor selected from the group consisting of: a pressure sensor, a global positioning system sensor, an accelerometer, a magnetometer, a gyroscope, a hall sensor, a temperature sensor, a cellular phone module, and a combination thereof.

17. The sports ball of claim 1, wherein the pit comprises a mass of less than or equal to 50 grams.

18. A sports ball, comprising:

a hollow shell; and a pit suspended within the hollow shell by a plurality of cords, each of the plurality of cords comprising a frayed end secured to the hollow shell at one of a plurality of spaced apart locations, wherein each of the spaced apart locations comprises a pad bonded to an exterior surface of the hollow shell, wherein the frayed end of each cord is bonded to the pad at each respective spaced apart location, wherein each pad comprises a first pad layer and a second pad layer, and wherein the frayed end of each respective cord is sandwiched between the first pad layer and the second pad layer of a respective pad.

19. A sports ball, comprising:

a hollow shell; and a pit suspended within the hollow shell by a plurality of cords, wherein:

each of the plurality of cords comprises:

a first end coupled to the hollow shell at a first location, a second end coupled to the hollow shell at a second location, and a center portion coupled to the pit;

the first location comprises a first pad bonded to an exterior surface of the hollow shell;

the second location comprises a second pad bonded to the exterior surface of the hollow shell;

each of the plurality cords is a fibrous cord;

the first end of one of the plurality of cords comprises frayed fibers of the cord bonded to the first pad;

the first pad comprises a first pad layer and a second pad layer; and the frayed fibers are sandwiched between the first pad layer and the second pad layer.

20. The sports ball of claim 19, wherein the first pad layer comprises an opening through which the first end of the cord comprising the frayed fibers is received.

21. The sports ball of claim 19, wherein the first pad layer comprises a first effective diameter, and wherein the second pad layer comprises a second effective diameter greater than the first effective diameter.

22. A sports ball, comprising:

a hollow shell; and a pit suspended within the hollow shell by a plurality of cords, wherein:

each of the plurality of cords comprises:

a first end coupled to the hollow shell at a first location, a second end coupled to the hollow shell at a second location, and a center portion coupled to the pit;

the center portion of each of the plurality of cords is looped through one of a plurality of grooves located on an exterior surface of the pit; and each of the plurality of grooves comprises a first curve, a second curve, and a socket connecting the first curve and the second curve.

23. The sports ball of claim 22, wherein each of the plurality of cords extends to a respective one of the first locations from the first curve of one of the plurality of grooves, and wherein each of the plurality of cords extends to a respective one of the second locations from the second curve of one of the plurality of grooves.

* * * * *